US006349642B1

(12) United States Patent
Olomski et al.

(10) Patent No.: US 6,349,642 B1
(45) Date of Patent: Feb. 26, 2002

(54) OPEN-LOOP DRIVE CONTROL AND A METHOD FOR THE OPEN-LOOP DRIVE CONTROL OF SHEET-FED PRINTING MACHINES

(75) Inventors: Jürgen Olomski, Herzogenaurach; Hans-Peter Tröndle, Forchheim; Ralf Viefhaus, Nürnberg, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/495,467

(22) Filed: Feb. 1, 2000

(30) Foreign Application Priority Data

Feb. 1, 1999 (DE) ..... 199 03 869

(51) Int. Cl.[7] ..... B41F 7/06; B41F 13/12

(52) U.S. Cl. ..... 101/183; 101/216; 101/248; 101/492

(58) Field of Search ..... 101/171, 174, 101/177, 183, 211, 216, 217, 483, 484, 492, 248

(56) References Cited

U.S. PATENT DOCUMENTS 3,452,261 A * 6/1969 Tagliasacchi ..... 318/77
3,557,692 A * 1/1971 Lee ..... 101/183
3,847,079 A * 11/1974 Dahlgren ..... 101/426
5,377,589 A * 1/1995 Kruger et al. ..... 101/248
5,398,603 A * 3/1995 Hartmann et al. ..... 101/183
5,481,971 A * 1/1996 Grutzmacher et al. ..... 101/183
5,826,505 A * 10/1998 Volz et al. ..... 101/183
5,983,793 A * 11/1999 Volz et al. ..... 101/216
5,988,063 A * 11/1999 Brandenburg et al. ..... 101/219
6,050,188 A * 4/2000 Bolza-Schunemann ..... 101/183
6,095,043 A * 8/2000 Hartmann et al. ..... 101/183

* cited by examiner

*Primary Examiner*—Eugene Eickholt
(74) *Attorney, Agent, or Firm*—Staas & Halsey LLP

(57) ABSTRACT

In a conventional sheet-fed printing machine having a central drive, the dynamic positional deviation with respect to a setpoint value continually increases from printing unit to printing unit due to the elasticity (a vibratory multi-mass system). Thus, the precision is dependent on the number of printing units. A mechanical interconnection of the individual cylinders of the sheet-fed printing machine is partially removed and replaced by individual drives is, therefore, provided. In the multiple motor open-loop drive control described, the fault does not increase because in each printing unit, the torque is supplied separately, and all drives are closed-loop controlled using the same reference variable.

11 Claims, 3 Drawing Sheets

OPEN-LOOP DRIVE CONTROL AND A METHOD FOR THE OPEN-LOOP DRIVE CONTROL OF SHEET-FED PRINTING MACHINES

FIELD OF THE INVENTION

The present invention relates to an open-loop drive control for sheet-fed printing machines having a multiplicity of printing units (printing mechanisms). Each printing unit includes cylinders that are mechanically coupled to each other. In particular, a feeder, transfer rollers, printing cylinders and rubber cylinders are coupled to each other as a sheet-travel module. The printing units further include plate cylinders, inking systems, and a delivery assembly, and are driven by an electrical drive.

BACKGROUND INFORMATION

Sheet-fed printing machines generally include a plurality of printing units, which are mechanically coupled to each other in a roller system. In this context, each printing unit has associated to it an inking system, which acts upon a plate cylinder. Every plate cylinder is mechanically coupled to a rubber cylinder and, via the latter, to a printing cylinder. The printing cylinders of individual printing units are in mechanical contact with each other via so-called transfer rollers. The first printing cylinder for its part is mechanically coupled to a feeder, the last printing cylinder to a delivery assembly. In one conventional sheet-fed printing machine, each printing unit is mechanically coupled to the aforementioned specific cylinders as a so-called sheet-travel module.

In one conventional sheet-fed printing machine, all the cylinders—in the form of rollers—that participate in the paper guidance and in the printing are mechanically coupled via a traversing wheel train or a vertical shaft. FIG. 1 shows the design of a sheet-fed printing machine of this type having four printing units 1 through 4. The system is depicted in a cross-section of individual cylinders. Four printing units 1 through 4 are illustrated, having, respectively, inking system F1 through F4, plate cylinder P1 through P4, rubber cylinder G1 through G4, and printing cylinders D1 through D4, which are connected via transfer rollers T2 through T4. In addition, a feeder AN and a delivery assembly AB are shown.

Conventionally, a mechanical interconnection of this type of sheet-fed printing machine is moved by a central electrical drive. However, the cylinders that are coupled in this manner represent a vibratory multiple-mass system. Thus, vibrations can affect the printing precision negatively. As a result, the number of printing towers or printing units that can be included in the mechanical interconnection is limited.

In a conventional sheet-fed printing machine having the mechanical interconnection described involving a central drive, the dynamic positional deviation with respect to a setpoint value continually increases from printing unit to printing unit due to the elasticity of the multiple-mass system. Thus, precision is dependent on the number of printing units. In the case of a prescribed mandatory level of precision, it follows that the number of printing units is limited.

SUMMARY

An object of the present invention is to provide a drive control for a sheet-fed printing machine having a multiplicity of printing units which avoids the problem of the dynamic positional deviation increasing from printing unit to printing unit, delivers a higher level of precision, and in addition makes it possible to realize a greater number of printing units in the mechanical interconnection. A further object is to provide a corresponding method for the drive control.

According to the present invention, in an open-loop drive control for sheet-fed printing machines of the type discussed above, for example, the mechanical coupling of the individual cylinders AN, T1 . . . T4, D . . . D4, G1 . . . G4, P1 . . . P4, F1 . . . F4, AB is at least partially removed and provision is made in the de-coupled cylinders for further electrical drives MP1 . . . MP4, MG1 . . . MG4, which, in each case, have an assigned separate closed-loop control R_MP1 . . . R_MP4, R_MG1 . . . R_MG4, all closed-loop controls R_MP1 . . . R_MP4, R_MG1 . . . R_MG4 obeying a common reference variable A_Soll.

A method is also provided for the open-loop drive control for sheet-fed printing machines in which the mechanical coupling of individual cylinders AN, T1 . . . T4, D1 . . . D4, G1 . . . G4, P1 . . . P4, F1 . . . F4, AB is at least partially removed and the decoupled cylinders are electrically driven independently of each other, there being, in each case, an assigned separate closed-loop control R_MP . . . R_MP4, R_MG1 . . . R_MG4, each closed-loop control R_MP1 . . . R_MP4, R_MG1 . . . R_MG4 obeying a common reference variable A_Soll.

The present invention, which, for example, partially removes the mechanical interconnection of the sheet-travel modules of individual printing units and replace it with individual drives, offers the advantage that as a result of a multi-motor open-loop drive control, the fault does not continue to increase from printing unit to printing unit, since at each printing unit the torque is supplied separately, and all the drives are closed-loop controlled at the same reference variable.

In one embodiment of the present invention, the coupling between the rubber cylinders and the plate cylinders is removed and is replaced by individual drives in the rubber cylinders and the plate cylinders.

A further advantageous embodiment of the present invention prescribes a common reference variable through a reference variable interpolator, which continually interpolates the reference variable in accordance with the acceleration capacity of the sheet-fed printing machine and with a preselected rotational speed.

It is also advantageous if the closed-loop control of each drive is designed in a cascading arrangement made up of a closed-loop control of position, rotational-speed, and power. The highest precision is achieved using an open-loop drive control according to the present invention in accordance with a further specific advantageous embodiment, such that every closed-loop control of a drive has the same delay time constant.

The delay times can be reduced and the vibrations dampened in a particularly advantageous manner due to the fact that each closed-loop control of a drive has a rotational-speed and power pilot control (precontrol) for reducing delay times.

If set-up, cleaning, or maintenance work is to be carried out on a conventional sheet-fed printing machine having a central drive, then all the cylinders must be moved synchronously, as a result of which such tasks cannot be carried out in parallel, thus impairing machine amortization.

This problem can be circumvented by providing a drive control according to the present invention in which the closed-loop control R_MG1 . . . R_MG4 of each rubber cylinder G1 . . . G4 or closed-loop control R_MP1 . . . R_MP4 of each plate cylinder P1 . . . P4, instead of obeying common reference variable A_Soll, obeys a reference variable A_P1, A_P2 of its own, separate from a sheet-travel motion.

Further advantages and details of the present invention are provided on the basis of the following description of an exemplary embodiment and in connection with the Figures. In this context, elements having the same functionality are designated using the same reference numerals.

DETAILED DESCRIPTION

Figure 1:
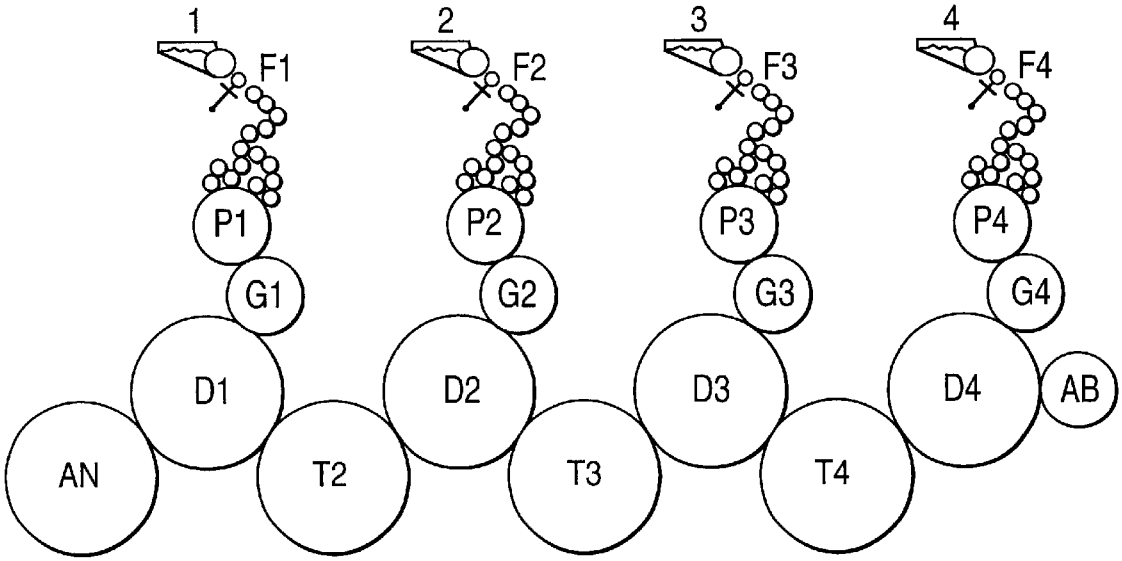
FIG. 1 (PRIOR ART)
FIG. 1 shows a conventional sheet-fed printing machine having four printing units; in particular, a cross-section of the individual rollers is illustrated.

FIG. 1 was discussed above in connection with the description of a conventional sheet-fed printing machine. A sheet-fed printing machine having four printing units 1 through 4 is shown, the printing units, in each case, being mechanically coupled as a sheet-travel module. Each printing unit has an inking system F1 through F4, a plate cylinder P1 through P4, a rubber cylinder G1 through G4, and a printing cylinder D1 through D4. Individual printing units or printing cylinders D1 through D4 are mechanically coupled to each other by transfer rollers T2 through T4. First printing unit 1 has, at printing cylinder D1, a feeder AN, and final printing unit 4 has at printing cylinder D4 a delivery assembly AB.

Figure 2:
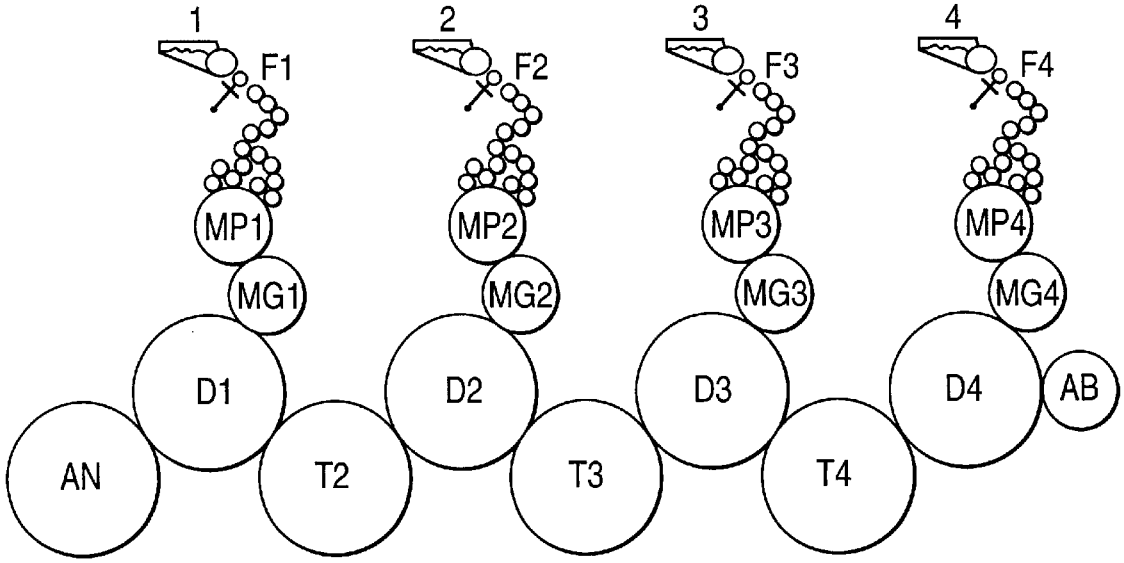
FIG. 2 shows a sheet-fed printing machine according to the present invention having a multiple-motor drive, in a cross-section of the rollers.

FIG. 2 shows a sheet-fed printing machine having a multiple-motor drive according to an example embodiment of the present invention. As shown in FIG. 2, the coupling between rubber cylinders G1 through G4 and plate cylinders P1 through P4 is removed and replaced by individual drives MG1 through MG4 for the rubber cylinders and MP1 through MP4 for the plate cylinders.

As a result of the fact that the mechanical coupling between the rubber cylinders and the plate cylinders is removed, the central drive is dispensed with and is replaced by individual drives MG1 through MG4 on the rubber cylinders and MP1 through the MP4 on the plate cylinders. Feeder AN, transfer rollers T2 through T4, printing cylinders D1 through D4, and rubber cylinders G1 through G4 continue to be mechanically coupled as a so-called sheet-travel module BLM, just as, in each case, is printing unit 1 through 4, plate cylinder P1 through P4, and inking system F1 through F4.

In the printing operation, the drives are controlled using a common reference variable A_Soll on a reference variable interpolator for sheet-travel module BLM.

Figure 3:
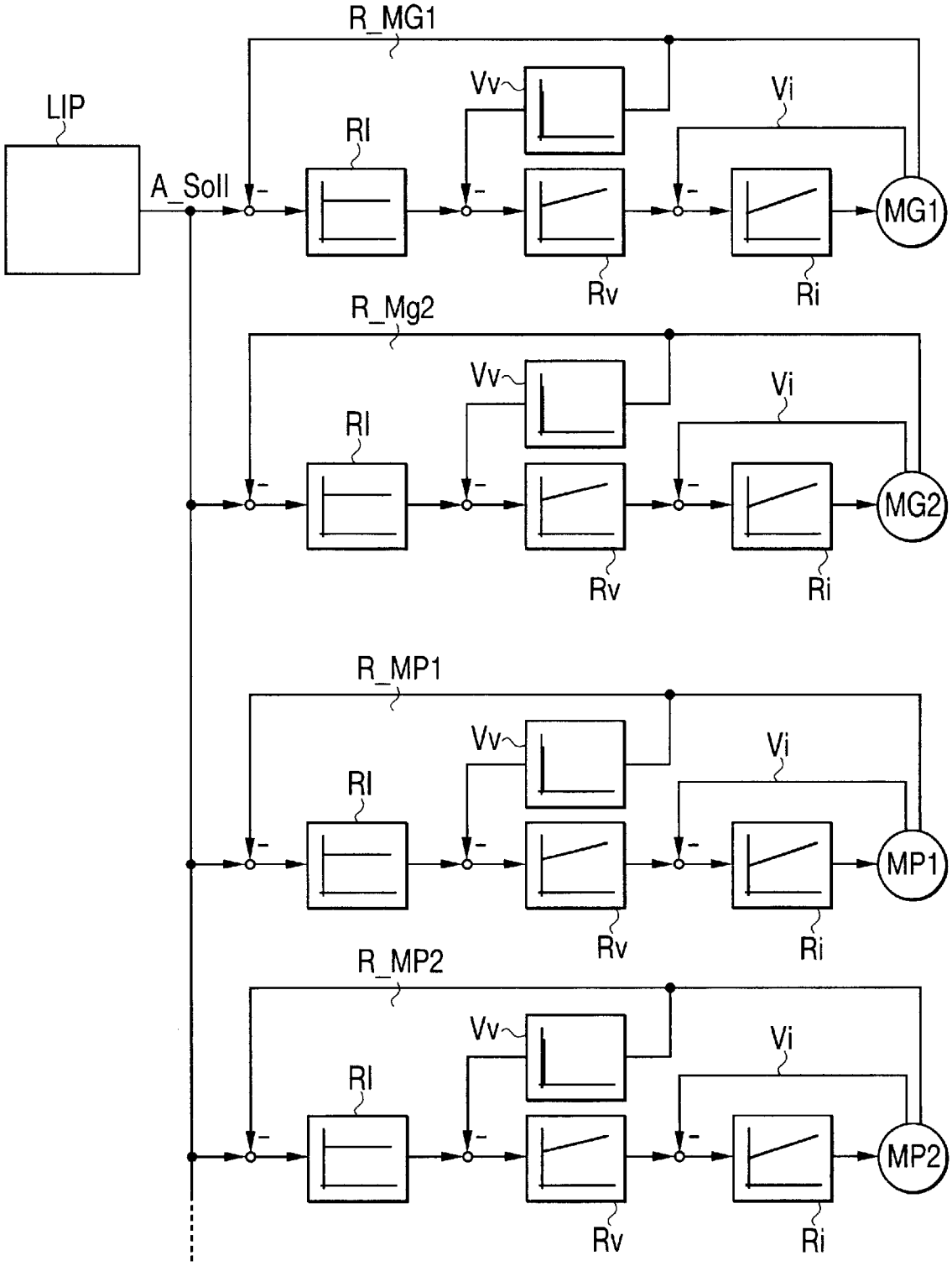
FIG. 3 shows a circuit diagram of a multiple-motor open-loop drive control of a sheet-fed printing machine according to the present invention.

For this purpose, FIG. 3 depicts a circuit diagram of a multiple motor open-loop drive control for a sheet-fed printing machine according to the invention, which makes possible an open-loop control of the drives in the printing operation using a common reference variable A_Soll. All drives MG1 through MG4 and MP1 through MP4 are closed-loop controlled individually via a cascaded closed-loop control R_MG1 through R_MG4 and R_MP1 through R_MP4, composed of position control R1, rotational speed control Rv, and power control Ri. In the representation according to FIG. 3, for example, the corresponding closed-loop controls for drives MG1, MG2, and MP1, MP2 are depicted. All closed-loop controls have the same cascaded design and are acted upon by reference variable interpolator LIP having the aforementioned common reference variable A_Soll. Each drive MG1 through MG4 and MP1 through MP4 thus obeys reference variable A_Soll within the parameters of its control precision. This reference variable is constantly interpolated by an open-loop control S in accordance with the acceleration capacity of the sheet-fed printing machine and the desired rotational speed.

Each closed-loop control R_MG1 through R_MG4 and R_MP1 through R_MP4, in this context, may be adjusted so that the delay time constants are low and all closed-loop control circuits are the same. Delay times are advantageously also reduced by a rotational-speed pilot control Vv and a power pilot control Vi. In the block diagram according to FIG. 3, this can be seen in the fact that-each cascaded closed-loop control composed of position, rotational speed, and power closed-loop control has a power actual value that is fed back by drive MG1 through MG4 and MP1 through MP4, in each case, to power controller Ri, and a rotational actual value that is fed back to input rotational speed controller Rv.

Each axle moves with respect to reference variable A_Soll in the same fault tolerance range. This fault tolerance directly determines the register precision in the paper travel direction of the sheet-fed printing machine. For this purpose, the fault that is aimed at must be smaller than the desired register precision.

Using an open-loop drive control according to the present invention, it is also possible, for set up, servicing, and cleaning work on the sheet-fed printing machine, to separate the motion of individual printing towers 1 through 4, composed of plate cylinders P1 through P4 and inking systems F1 through F4, from the motion of sheet-travel module BLM, composed of rubber cylinders G1 through G4 and printing cylinders D1 through D4 and of other printing towers 1 through 4. Thus, it is possible for the other printing towers to move at a different speed or even to be motionless.

Figure 4:
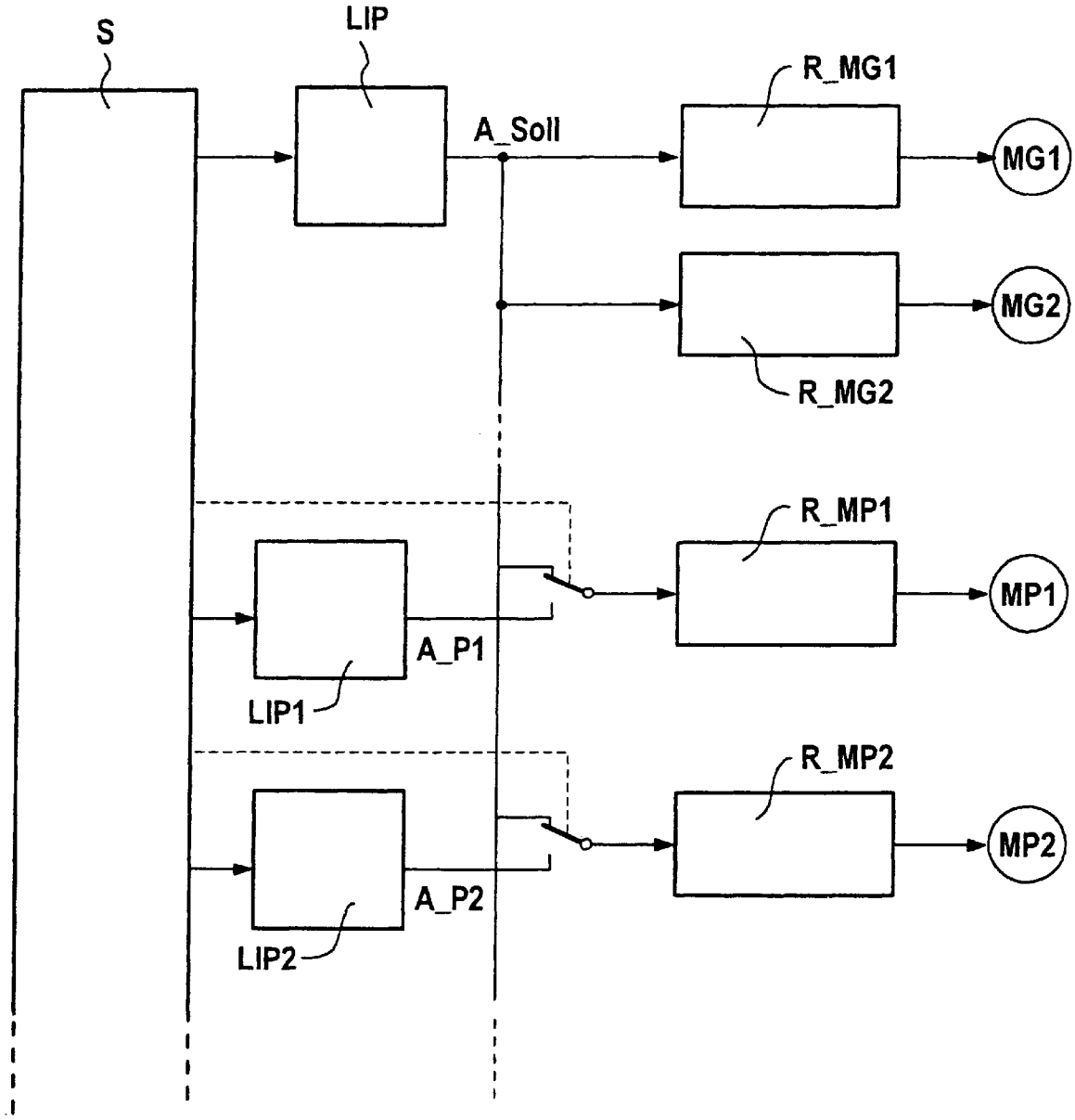
FIG. 4 shows a schematic sketch of an open-loop control and interpolation of the plate cylinders for carrying out cleaning work.

FIG. 4 shows a block diagram of an open loop control and an interpolation of the plate cylinders, which builds on the representation depicted in FIG. 3, and making possible a separation of the plate cylinders and inking systems from the motion of sheet-travel module BLM and other printing towers. By way of example, the closed-loop control of the electrical drives of rubber cylinders MG1 and MG2 as well as of plate cylinders MP1 and MP2 is shown. The broken lines of the output of reference variable interpolator LIP having common reference variable A_Soll show that the closed-loop controls of the other electrical drives are carried out in the same manner. Each electrical drive MG1, MG2, and MP1, MP2 has an associated closed-loop control R_MG1, R_MG2 and R_MP1, R_MP2, which has the design depicted in the representation according to FIG. 3. During printing operation, each of these closed-loop controls is acted upon by reference variable interpolator LIP having common reference variable A_Soll.

In addition, further reference variable interpolators LIP1 and LIP2 may be provided, which are assigned, respectively, to closed-loop controls R_MP1 and R_MP2. Using an open-loop control module S, it is possible, for set-up, servicing, or cleaning work, to carry out a switchover of the input of closed-loop controls R_MP1 and R_MP2 to reference variable interpolator LIP1 or LIP2, respectively, and accordingly to have closed-loop control R_MP1 acted upon by its own reference variable A_P1 and further closed-loop control R_MP2 acted upon by its own reference variable A_P2. In this way, it is possible to move the electrical drives of individual plate cylinders MP1 and MP2 at different speeds from the drives of corresponding rubber cylinders MG1 and MG2, or even to stop electrical drives MP1 and MP2. As a result of this design of an open-loop drive control for a sheet-fed printing machine, depicted in the block diagram of FIG. 4, individual plate cylinder drives MP1 and MP2 can be interpolated separately from the sheet-travel motion in accordance with a prescribed instruction. For this purpose, the individual interpolators LIP1 and LIP2 are made available to the printing units. Of course, it is also possible to assign the separate reference variable interpolators LIP1 and LIP2, not to closed-loop controls R_MP1 and R_MP2 for the plate cylinders, but rather to the corresponding closed-loop controls R_MG1 and R_MG2 for the rubber cylinders.

Reference Numeral List

| | |
|---|---|
| 1,2,3,4 | Printing unit |
| F1 through F4 | Inking system |
| P1 through P4 | Plate cylinder |
| G1 through G4 | Rubber cylinder |
| D1 through D4 | Printing cylinder |
| T2 through T4 | Transfer roller |
| AN | Feeder |
| AB | Delivery assembly |
| MP1 through MP4 | Drive for the plate cylinder |
| MG1 through MG4 | Drive for the rubber cylinder |
| S | Open-loop control module |
| LIP | Reference variable interpolator |
| LIP1, LIP2 | further reference variable interpolators |
| A_Soll | Common reference variable |
| A_P1, A_P2 | Separate reference variables |
| R_MG1, R_MG2 | Closed-loop control for the drive of the rubber cylinders |
| R_MP1, R_MP2 | Closed-loop control for the drive of the plate cylinders |
| R1 | Position closed-loop controller |
| Ri | Rotational speed closed-loop controller |
| Vv | Rotational speed pilot control |
| Vi | Power pilot control |

What is claimed is:

1. A drive control for a sheet-fed printing machine, comprising:

a plurality of printing units, each of the printing units including cylinders, at least some of the cylinders being mechanically decoupled from others of the cylinders, the cylinders of all of the printing units together including a feeder, transfer rollers, printing cylinders, rubber cylinders, plate cylinders and inking systems, at least some of the cylinders forming a sheet-travel module;

electrical drives, each having an assigned, separate control, all of the assigned separate controls having a common reference variable, each of the mechanically decoupled cylinders being assigned a separate, respective one of the electrical drives; and a reference variable interpolator prescribing the common reference variable, the interpolator continually interpolating the common reference variable as a function of an acceleration capacity of the printing machine and a preselected rotational speed.

2. The drive control-according to claim 1, wherein the assigned separate controls are closed-loop controls.

3. The device control according to claim 1, wherein the decoupled cylinders include rubber cylinders and plate cylinders, the rubber cylinders being mechanically de-coupled from the plate cylinders.

4. The drive control according to claim 1, wherein each of the electrical drives is designed in a cascaded control composed of a control of position, rotational speed, and power.

5. The drive control according to claim 1, wherein the assigned separate controls have the same delay time constant.

6. The drive control according to claim 4, wherein all of the assigned separate controls have a rotational-speed and power pilot control for reducing delay time.

7. A drive control for a sheet-fed printing machine, comprising:

a plurality of printing units, each of the printing units including cylinders, at least some of the cylinders being mechanically decoupled from others of the cylinders, the cylinders of all of the printing units together including a feeder, transfer rollers, printing cylinders, rubber cylinders, plate cylinders and inking systems, at least some of the cylinders forming a sheet-travel module;

electrical drives, each having an assigned, separate control, at least one of the electrical drives having a separate, respective reference variable, separate from a sheet-travel motion, each of the mechanically decoupled cylinders being assigned a separate, respective one of the electrical drives; and a reference variable interpolator prescribing the common reference variable, the interpolator continually interpolating the common reference variable as a function of an acceleration capacity of the printing machine and a preselected rotational speed.

8. A method for the drive control of a sheet-fed printing machine, the printing machine including a plurality of printing units, comprising:

providing cylinders for each of the printing units, at least some of the cylinders being mechanically decoupled from others of the cylinders, the cylinders of all of the printing units together including a feeder, transfer rollers, printing cylinders, rubber cylinders, plate cylinders and inking systems and forming a sheet-travel module;

electrically driving each of the mechanically decoupled cylinders with a respective, independent electrical drive;

assigning to each of the electrical drives a separate control, all of the assigned separate controls having a common reference variable;

prescribing the common reference variable by a reference variable interpolator; and continually interpolating, by the interpolator, the common reference variable as a function of an acceleration capacity of the printing machine and a preselected rotational speed.

9. The method according to claim 8, wherein the decoupled cylinders including the rubber cylinders and the plate cylinders, the rubber cylinders and the plate cylinders being mechanically decoupled from each other, further comprising:

controlling-each rubber cylinder and each plate cylinder independently from the other.

10. The method according to claim 8, further comprising:

cascading a control of position, rotational speed and power for the separate control of each drive.

11. A sheet-fed printing machine, comprising:

a plurality of printing units, each having cylinders to convey a sheet, a portion of the cylinders of a first printing unit being mechanically decoupled from a portion of the cylinders of a second printing unit;

drive units, each under separate control, all of the separate controls having a common reference variable, such that at least one drive unit drives the portion of the cylinders of the first printing unit that are mechanically decoupled and at least one drive unit drives the portion of the cylinders of the second printing unit that are mechanically decoupled; and a reference variable interpolator prescribing the common reference variable, the interpolator continually interpolating the common reference variable as a function of an acceleration capacity of the printing machine and a pre-selected rotational speed.

* * * * *